US005597618A

United States Patent [19]

Bayer, Jr. et al.

[11] Patent Number: 5,597,618

[45] Date of Patent: Jan. 28, 1997

[54] APPLICATION MEMBER FOR APPLYING A COATING MATERIAL TO A SUBSTRATE

[75] Inventors: Glen H. Bayer, Jr., Cottage Grove; Timothy J. O'Leary, St. Paul, both of Minn.

[73] Assignee: Minnesota Mining and Manufacturing Company, St. Paul, Minn.

[21] Appl. No.: 601,379

[22] Filed: Feb. 14, 1996

Related U.S. Application Data

[63] Continuation of Ser. No. 393,881, Feb. 23, 1995, abandoned, which is a continuation of Ser. No. 56,362, Apr. 30, 1993, abandoned.

[51] Int. Cl.[6] ..... B05C 1/12; B05D 1/28; B05D 5/00; B05D 5/10

[52] U.S. Cl. ..... 427/207.1; 427/208.6; 427/288; 427/428; 118/210; 118/212; 118/244

[58] Field of Search ..... 427/207.1, 208.4, 427/208.6, 288, 428; 118/210, 212, 244, 246, 248, 249, 258, 261, 262; 29/895.3, 895.31, 895.32; 101/348; 492/30, 37, 59

[56] References Cited

U.S. PATENT DOCUMENTS

| | | | |
|---|---|---|---|
| 647,833 | 4/1900 | Henricus | 427/270 |
| 1,707,400 | 4/1929 | Kerruish | 492/30 |
| 2,386,731 | 10/1945 | Wenzelberger | 118/262 |
| 3,496,012 | 2/1970 | Biorseth | 117/111 |
| 3,559,572 | 2/1971 | Hackley | 118/249 |
| 3,650,242 | 3/1972 | Mahoney | 118/246 |
| 3,729,338 | 4/1973 | Lehmann et al. | 427/208.4 |
| 3,941,181 | 3/1976 | Stoody | 164/59.1 |
| 3,955,260 | 5/1976 | Sherden | 118/Dig. 5 |
| 4,004,774 | 1/1977 | Houston | 427/291 |
| 4,085,702 | 4/1978 | Consaul et al. | 118/60 |
| 4,097,711 | 6/1978 | Benerjee | 219/76.15 |
| 4,107,815 | 8/1978 | Dumesnil, Jr. | 118/258 |
| 4,167,914 | 9/1979 | Mladota | 118/33 |
| 4,211,741 | 8/1980 | Ostoich | 264/173 |
| 4,287,846 | 9/1981 | Klein | 118/262 |
| 4,302,486 | 11/1981 | Harbs | 427/428 |
| 4,426,344 | 1/1984 | Dinter et al. | 264/171 |
| 4,430,284 | 2/1984 | Rasmussen | 264/171 |
| 4,443,397 | 4/1984 | Hahn et al. | 264/171 |
| 4,465,015 | 8/1984 | Osta et al. | 118/222 |
| 4,569,864 | 2/1986 | McIntyre | 118/262 |
| 4,669,965 | 6/1987 | Murakami | 425/133.5 |

(List continued on next page.)

FOREIGN PATENT DOCUMENTS

| | | | |
|---|---|---|---|
| 0012789 | 9/1980 | European Pat. Off. . | |
| 0279579 | 8/1988 | European Pat. Off. . | |
| 1401083 | 12/1965 | France | 118/DIG. 15 |
| 2442667 | 6/1980 | France | 118/261 |
| 3537433 | 9/1986 | Germany . | |
| 61-114852 | 6/1986 | Japan . | |
| 1190325 | 5/1970 | United Kingdom . | |
| 1381328 | 1/1975 | United Kingdom | 118/261 |
| 2078140 | 1/1982 | United Kingdom . | |

OTHER PUBLICATIONS

European Search Report—EP 94 40 00931.

*Primary Examiner*—Shrive Beck
*Assistant Examiner*—Fred J. Parker
*Attorney, Agent, or Firm*—Gary L. Griswold; Walter N. Kirn; William L. Huebsch

[57] ABSTRACT

An application member for applying a coating material, such as a pressure sensitive adhesive, to a receiving surface, such as a paper substrate. The application member includes a cylindrical peripheral surface and a plurality of spaced, discrete structures projecting from the peripheral surface of the hub, whereby adhesive may be carried on and between the structures prior to being applied to the receiving surface. By varying the surface velocity of the application member relative to the velocity of the substrate, the characteristics of the adhesive layer applied to the substrate may be changed. Also provided is a process for making the application member by retaining individual particles within substantially all of a plurality of indentations in the peripheral surface of a hub.

24 Claims, 4 Drawing Sheets

U.S. PATENT DOCUMENTS

| | | | |
|---|---|---|---|
| 4,772,195 | 9/1988 | Touchet | 425/131.1 |
| 4,871,593 | 10/1989 | McIntyre | 427/428 |
| 4,882,990 | 11/1989 | Ijichi | 101/348 |
| 4,889,234 | 12/1989 | Sorenson et al. | 206/456 |
| 5,030,484 | 7/1991 | Chino et al. | 427/434.3 |
| 5,033,380 | 7/1991 | Sonobe et al. | 29/895.32 |
| 5,042,383 | 8/1991 | Wirz | 492/30 |
| 5,066,435 | 11/1991 | Lorenz et al. | 264/40.5 |
| 5,069,934 | 12/1991 | Chino et al. | 427/131 |
| 5,072,688 | 12/1991 | Chino et al. | 118/411 |
| 5,099,759 | 3/1992 | Sonobe et al. | 29/895.32 |
| 5,113,760 | 5/1992 | Sonobe et al. | 101/348 |

APPLICATION MEMBER FOR APPLYING A COATING MATERIAL TO A SUBSTRATE

This is a continuation of application Ser. No. 08/393,881, filed Feb. 23, 1995, now abandoned which was a continuation of application Ser. No. 08/393,362, filed Apr. 30, 1993, now abandoned.

TECHNICAL FIELD

The invention relates to a method and apparatus for applying coating material to a receiving surface.

BACKGROUND OF THE INVENTION

It is often desirable to coat a substrate with a coating material, such as ink or an adhesive, in a desired location on the substrate. For example, pressure sensitive adhesive tape includes a web substrate coated with a layer of pressure sensitive adhesive. Similarly, POST-IT brand repositionable notes, available from the Minnesota Mining and Manufacturing Company of St. Paul, Minn., include a substrate having a band of pressure sensitive adhesive coated over a portion of the substrate. In these and other fields, it is desirable to apply the coating material to the substrate in a controlled manner.

One process of applying a coating material to a substrate is known as gravure coating, and is illustrated schematically in FIG. 1. The process includes a supply 12 of a substrate 10, an application roller 14, and a supply of coating material 18 through which the application roller is drawn. Also shown are a backing roller 19 that opposes the application roller, a doctor blade 21 for wiping excess coating material from the application roller, and a winding system having one or more rollers 13 to draw the substrate between the application roller and the backing roller. As shown in FIG. 2, the application roller includes a peripheral surface 30 having a multitude of individual cells 32 that are recessed from the peripheral surface of the application roller. The cells may be arranged in any pattern, as shown in FIG. 3, wherein cells 32 are formed in the peripheral surface at certain locations, and no cells are formed in locations 34.

The cells collect the coating material as the application roller passes through the supply of coating material, and thus the areas of the peripheral surface without cells (e.g. locations 34) do not collect coating material. If any residual coating material collects on the peripheral surface of the application roller, doctor blade 21 wipes that material from the peripheral surface prior to contact with the substrate.

When the substrate passes the application interface between the application roller and the backing roller, the material is drawn out of each of the cells because the coating material has a greater affinity for the substrate than for the application roller. The surface speed of the application roller is matched to the speed of the substrate, to enable complete removal of the coating material from the individual cells. If the surface speed of the substrate is greater than or less than that of the surface of the application roller, the cells of the application roller will not be entirely evacuated. Incomplete evacuation of the cells is undesirable, because the predetermined amount of coating material has not been transferred to the substrate.

Gravure coating, while having its own utility, is not easily modified to enable a thinner or thicker layer of coating material to be applied to the substrate. Because the cells on the peripheral surface have a fixed size and shape, and because the speed of the application roller and the substrate are matched, a particular application roller consistently applies the same pattern and thickness of coating material to the substrate. To change the pattern or thickness of coating material that is applied to the substrate, the application roller must be removed and replaced with a coating roller having different surface characteristics (e.g. more or less cells, greater or smaller spacing between adjacent cells, or deeper or more shallow cells). The coating process must be halted while a new application roller is attached to the coating apparatus, and roller replacement is therefore costly and undesirable. It would therefore be desirable to provide a method and apparatus for applying a coating material in different amounts and in varying patterns, without having to replace the application roller.

Planographic coating is similar to gravure coating in some regards, and includes such coating methods as flexography, lithography, and both wet and dry offset coating. A notable difference between gravure coating and planographic coating relates to the peripheral surface of the application roller, and the manner in which the coating material is carried on that surface. Whereas gravure coating uses an application roller having a plurality of cells that are recessed from the peripheral surface of the application roller, planographic coating uses a pattern roller 50 having a multitude of island portions 52 that are raised above peripheral surface 54, as shown in FIGS. 4 and 5. The coating material 56 is carried only on the outermost surface of each island portion 52, and the pattern roller 50 contacts the application roller 55 to transfer the coating material thereto. The application roller then transfers coating material 56 onto a substrate 58 in the desired pattern.

Although planographic coating also has certain benefits, it is difficult to alter the coating parameters quickly and inexpensively. To change the pattern or thickness of coating material applied to the substrate, the pattern roller must typically be replaced, because the characteristics of a particular pattern roller determine the pattern and thickness of coating material that will be applied to the substrate. Replacement of the pattern roller must take place when the coating process is stopped, and is therefore undesirable for the same reasons as stated above with reference to gravure coating. Furthermore, if several different pattern rollers must be available for each coating apparatus to provide a desired coating thickness or pattern, the investment in pattern rollers may be substantial.

It is therefore desirable to provide a method and apparatus for applying coating material to a substrate, wherein the coating characteristics may be altered without replacing the application roller.

SUMMARY OF THE INVENTION

The present invention includes an application member for transferring a coating material from a supply of such material to a receiving surface, and for applying the material to the receiving surface. The application member includes a hub having a central axis for rotation thereabout, and having a generally cylindrical peripheral surface, and a plurality of spaced, discrete structures projecting from the peripheral surface of the hub. Rotation of the hub about the central axis enables the peripheral surface to pass a source of the coating material to receive the coating material, and to carry the coating material on the peripheral surface of the hub between and on said projecting structures toward an application interface to transfer the material from the peripheral surface to the receiving surface. Also provided is an application system for applying a coating material to a receiving surface, including the application member described above, and means for rotating said hub about the central axis thereof at a predetermined angular velocity. The rotating means enables the peripheral surface to pass a source of the coating material to receive the coating material and to carry the coating material on the peripheral surface between and on said projecting structures toward an application interface between the peripheral surface and the receiving surface, and to transfer said coating material to the receiving surface. An increase in the angular velocity of the hub increases the amount of coating material transferred to the receiving surface, and a decrease in the angular velocity of the hub decreases the amount of coating material transferred to the receiving surface.

In another aspect of the present invention, a method is provided for applying a coating material to a receiving surface. The method includes the steps of providing a hub having a central axis of rotation, and having a generally cylindrical peripheral surface including a plurality of spaced, discrete structures projecting from the peripheral surface; providing a source of the coating material in sufficient proximity to the peripheral surface to enable the peripheral surface to receive the coating material and to carry the coating material between and on said projecting structures; contacting a receiving surface with the peripheral surface of the hub at an application interface to enable the peripheral surface to transfer the coating material to the receiving surface at the interface; and rotating the hub to receive the coating material from the material source and to transfer the material to the receiving surface at the application interface. Also provided is a substrate coated with a coating material according to the method described above.

A method is also provided for making an application member for applying a coating material to a receiving surface. The method includes the steps of providing a hub having a generally cylindrical peripheral surface; forming a plurality of discrete indentations in the peripheral surface; and retaining a particle within substantially all of the indentations, such that a portion of each particle projects above the peripheral surface of the hub. Thus, the application member is adapted to carry the coating material on and between the particles prior to application to the receiving surface.

BRIEF DESCRIPTION OF THE DRAWINGS

The present invention will be described with reference to the appended Figures, wherein like structure is represented by like numbers throughout the several views, and wherein.

DETAILED DESCRIPTION OF THE INVENTION

The present invention relates broadly to an application member for applying a coating material to a receiving surface. The coating material may be any suitable material, including but not limited to adhesive (e.g. pressure sensitive adhesive) and ink. The receiving surface may be, for example, a substrate, such a continuous web of paper or polymeric material, or a belt or roller that receives the material and transfers the material to a substrate. Thus, the present invention, although described primarily with reference to the application of adhesive to a substrate, also has broad applicability to other coating operations as well.

Figure 1:
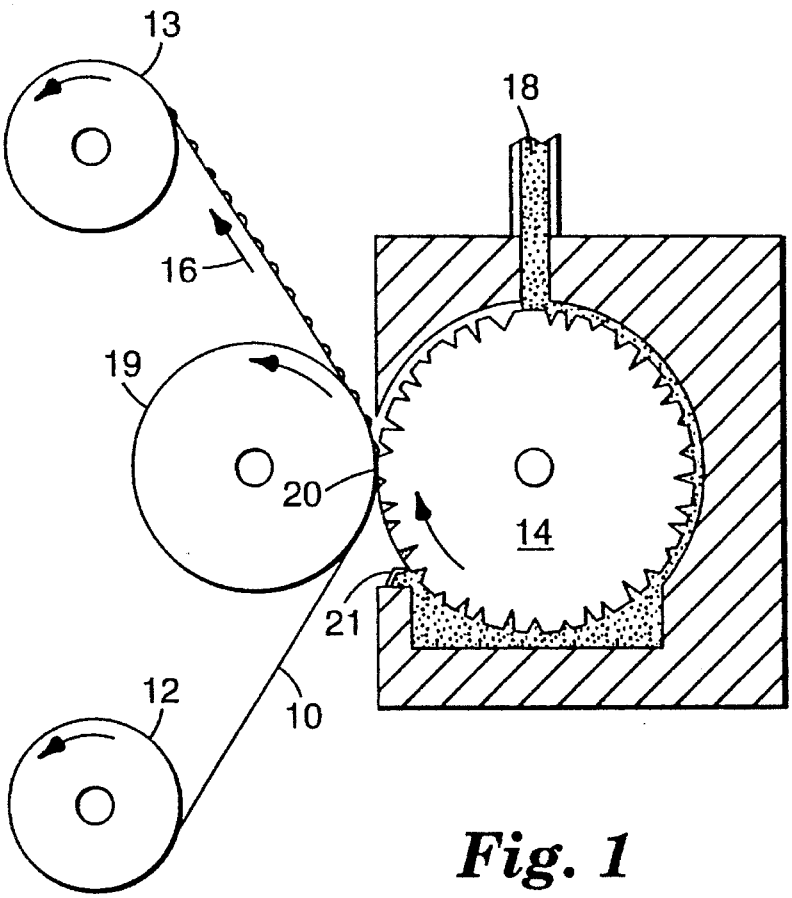
Fig. 1 PRIOR ART
FIG. 1 is a schematic illustration of a gravure coating process according to the prior art.
Figure 2:
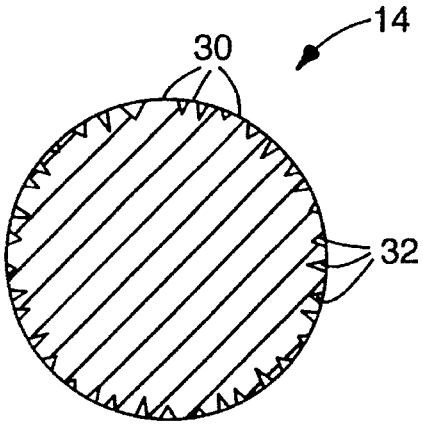
Fig. 2 PRIOR ART
FIG. 2 is a sectional view of a gravure application roller according to the prior art.
Figure 3:
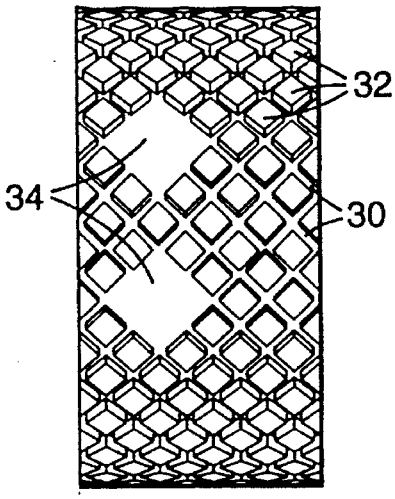
Fig. 3 PRIOR ART
FIG. 3 is a plan view of the face of a gravure application roller according to the prior art.
Figure 4:
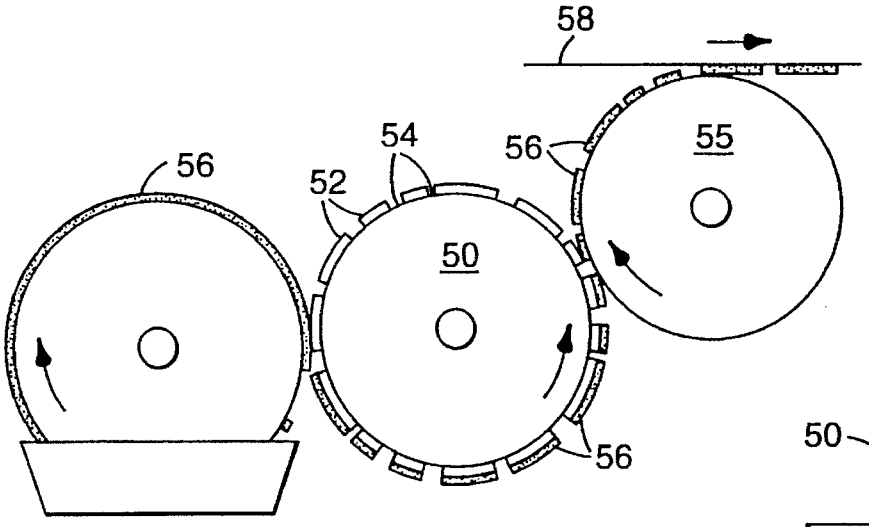
Fig. 4 PRIOR ART
FIG. 4 is a schematic illustration of a planographic coating process according to the prior art.
Figure 5:
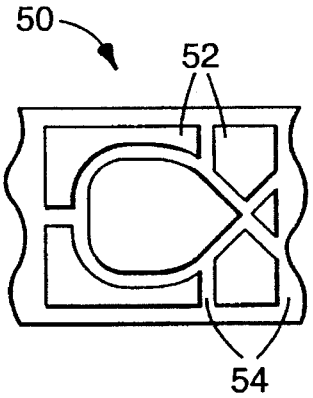
Fig. 5 PRIOR ART
FIG. 5 is a plan view of the face of a planographic transfer roller.
Figure 6:
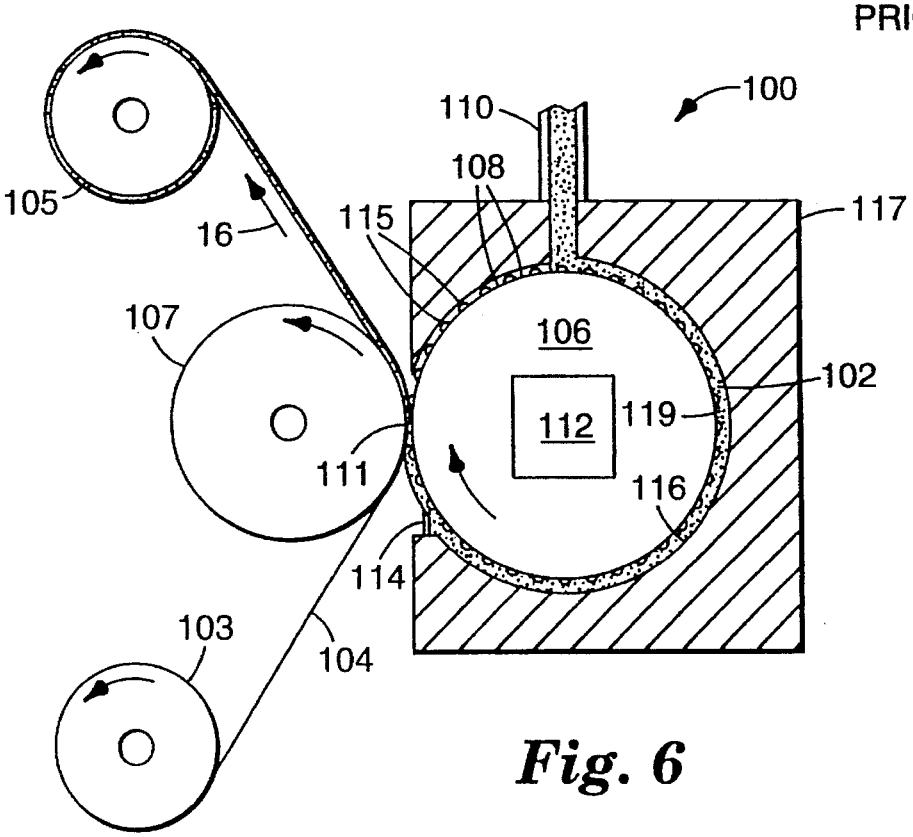
FIG. 6 is a cross-sectional view of the applicator apparatus of the present invention.

FIG. 6 illustrates an applicator for applying a coating material to a receiving surface. In the illustrated embodiment, an applicator apparatus 100 is shown for applying an adhesive 102 to a substrate 104, such as paper. The substrate is provided by supply roll 103, and is collected at collection roll 105. The applicator includes a hub 106 having a generally cylindrical peripheral surface 108 and a central axis about which the hub is adapted to rotate. The hub is rotatively supported at each end by support structure (not shown). Substrate 104 is fed between backing roller 107 and hub 106, and adhesive 102 is applied to the substrate 104 at application interface 111.

Also provided is a source 110 of adhesive 102, and means for rotating the hub about the central axis at a predetermined rotational velocity. In the illustrated embodiment, the rotating means comprises a motor 112. The hub is supported proximate the adhesive source 110, such that adhesive may be disposed on the peripheral surface of the hub at a controlled rate. Also provided is a metering bearing 114, which controls the amount of coating material that is allowed to accumulate on the surface of the application roller. Metering bearing 114 also seals coating material reservoir 116, to prevent coating material from leaking out of the reservoir. Reservoir 116 is preferably provided by a body 117 having a chamber 119 in which the application roller is rotatively supported, although alternate configurations can be provided instead.

A particular feature of the present invention relates to the topography of peripheral surface 108 of hub 106. The peripheral surface, in contrast to that of the application rollers of the prior art, includes a plurality of spaced, discrete structures projecting from the peripheral surface of the hub, between and on which structures the adhesive is carried. That is, the adhesive coats the entire peripheral surface of the application member, including the projecting structures. In one embodiment, the projecting structures are generally hemispherical, and measure on the order of 0.76 mm (0.003 in) high, relative to the remainder of the peripheral surface. Projecting structures 115 may be regularly spaced or irregularly spaced about the peripheral surface, and may be hemispherical, square, triangular, or any other suitable shape.

Figure 7:
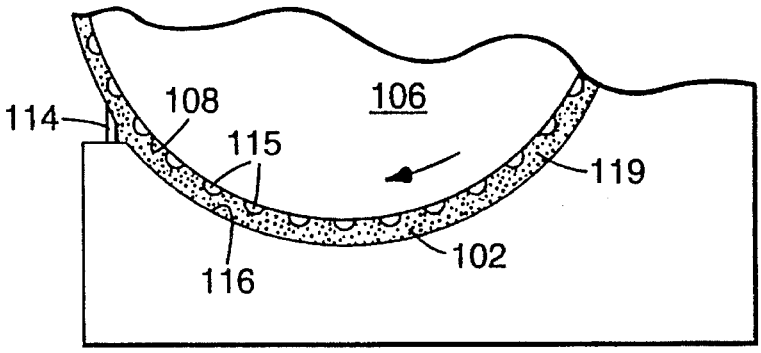
FIG. 7 is a cross-sectional view of an applicator roller according to the present invention, including a layer of material coated over the outer surface of the roller.

An exploded sectional view of a portion of the application roller 106, peripheral surface 108, and projecting structures 115 is shown in FIG. 7. Adhesive 102 is carried both between projecting structures 115 (in contrast to planographic application processes) and atop projecting structures 115 (in contrast to gravure coating processes). Metering bearing 114 controls the thickness of the layer of adhesive coated over and between the projecting structures.

Figure 8:
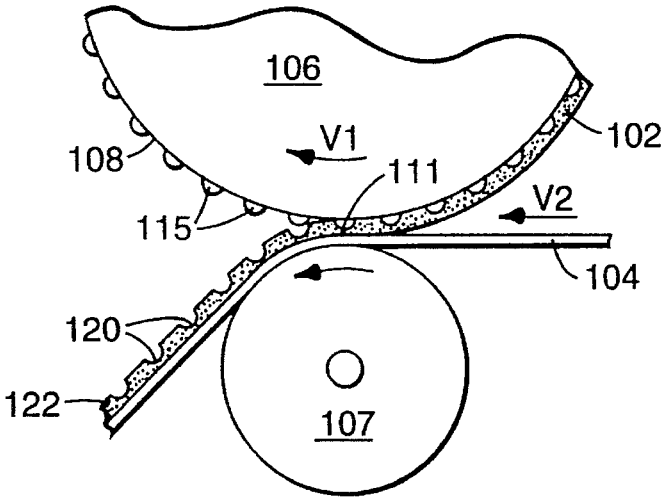
FIG. 8 is a schematic representation of the application of a material to a substrate, when the surface velocity of the application roller is approximately equal to the surface speed of the substrate.

At the application interface 111, adhesive 102 is transferred to substrate 104 as shown in FIG. 8. Application roller 106 is rotating with a surface velocity $V_1$ (the velocity of the surface at the application interface), and substrate 104 is travelling with a velocity $V_2$ that is approximately equal to $V_1$. Adhesive 102 is transferred to substrate 104 at the application interface 111, because the adhesive has a greater affinity for substrate 104 than for the peripheral surface 108 of application roller 106. Projecting structures 115 prevent adhesive from being transferred to substrate 104 at imprints 120.

This peripheral surface topography and transfer mechanism is believed to provide certain benefits. For example, complete adhesive coverage of the substrate may be achieved, and yet the adhesive surface 122 is discontinuous. A discontinuous adhesive surface has certain utility in conjunction with repositionable substrates, because the object to which the substrate is applied is not fully contacted by the adhesive surface 122. By providing application rollers having greater or fewer projecting structures, a greater or lesser percentage of the adhesive surface will be interrupted by imprints 120.

Figure 9:
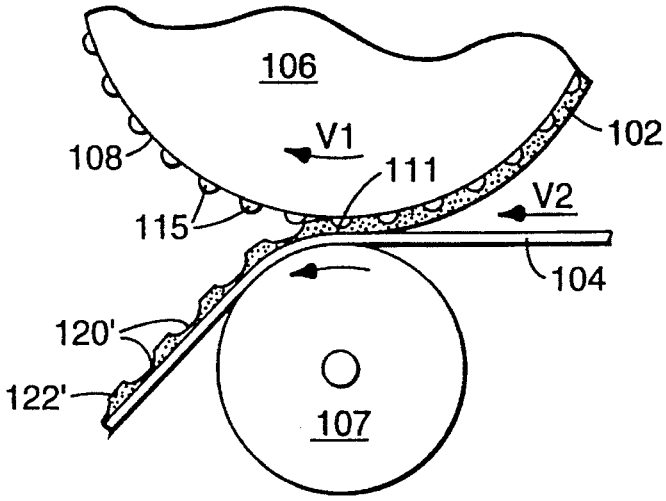
FIG. 9 is a schematic representation of the application of material to a substrate, when the surface velocity of the application roller is less than the velocity of the substrate.

Another feature of the applicator of the present invention relates to the ability to change the characteristics of the adhesive layer without substituting application rollers. For example, FIG. 9 illustrates the operation of the present application roller when the surface velocity of the application roller $V_1$ is less than the velocity of the substrate $V_2$. Adhesive 102 is applied to substrate 104 as described previously, but because projecting structures 115 are travelling more slowly than substrate 104, the projecting structures tend to wipe away, or "sweep out" adhesive at imprints 120'. The degree to which the projecting structures sweep out adhesive depends on the difference in velocity between the roller and the substrate at the interface, which may be desirable for providing a repositionable substrate.

Figure 10:
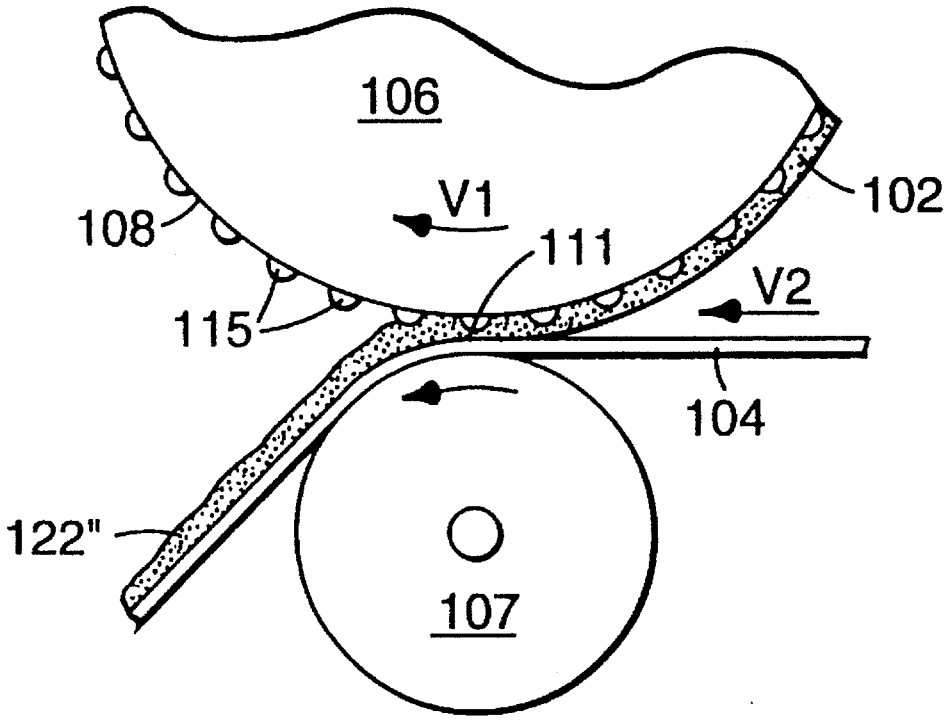
FIG. 10 is a schematic representation of the application of material to a substrate, when the surface velocity of the application roller is greater than the velocity of the substrate.

Another method of operating the applicator of the present invention is illustrated in FIG. 10, wherein the surface velocity of the application roller $V_1$ is greater than the velocity of the substrate $V_2$. Adhesive 102 is applied to substrate 104 as described previously, but because projecting structures 115 are travelling faster than substrate 104, the adhesive tends to build up, or be "loaded" onto the substrate. Adhesive loading may be beneficial because a thicker layer of adhesive may be applied to the substrate merely by changing the operating speed of the applicator roller, rather than having to change application rollers as with the prior art. Furthermore, adhesive surface 122" is virtually devoid of imprints, and thus the entire adhesive surface is presented for contact with an object to which the substrate is to be attached.

There are a legion of variations of the method and apparatus described above. For example, the projecting structures could be adapted to lightly contact the substrate at the application interface, thereby preventing any adhesive from being transferred to the substrate. The rotational velocity of the application roller could be altered during the production run, such that a portion of a substrate is coated with a relatively large amount of adhesive, and an adjacent portion is coated with a relatively small amount of adhesive. Alternatively, segments of the application roller can have different sizes or densities of particles, or both, to produce lanes or strips of different coating thicknesses, or different surface contact areas, or both. These strips would extend along the length of the substrate in generally parallel fashion.

A further description of the topography of the peripheral surface may be particularly described by the process used to produce that surface. A hub with a cylindrical peripheral surface was provided, where the surface was made of steel and was machined to a relatively smooth finish. The peripheral surface was then grit blasted to produce a plurality of indentations in the surface. The indentations were approximately hemispherical with a radius of approximately 1.0 mm (0.004 in). After the indentations were formed, spherical particles of tungsten carbide (WO) (or nickel chromium) were impelled against the surface, and were lodged within the indentations due to the frictional force between the particle and the edges of the indentations. A portion of each of the particles projected above the peripheral surface, which formed the projecting structures in the peripheral surface of the application roller.

To facilitate the transfer of the adhesive from the peripheral surface to the receiving surface at the application interface, a release coating was applied over the peripheral surface of the hub. The release coating, which comprised a fluorocarbon (such as TEFLON), was spray applied over the entire peripheral surface of the hub. The thickness of the release coating applied to the peripheral surface was approximately 0.76 mm (0.003 in).

The foregoing method of making a hub according to the present invention is intended to be illustrative, rather than limiting. Other methods of providing projecting structures on a peripheral surface, whereby a coating material is carried between and on the structures, will be apparent, and are intended to be within the scope of the present invention.

EXAMPLE

As an illustration of the method and apparatus of the present invention, the application roller described above was used to provide an adhesive coating on a substrate. The substrate was 20 lb bond paper, and was conveyed past the application roller at a velocity of approximately 1.52 m/s (300 ft/min).

An adhesive comprising 84 grams of isooctyl acrylate, 75 grams of octyl decyl acrylate (at 48% solids in ethyl acetate), 121 grams of ethyl acetate, and 0.92 grams of 4-acryloyloxy-benzophenone (at 25% solids in ethyl acetate) was prepared as follows. The components were charged in a 500 ml, four-necked reaction vessel. The reaction vessel was equipped with a stirrer, a thermometer, a condenser, an addition funnel, and a thermowatch. An solution of 0.36 grams catalyst of the type available from the E. I. DuPont de Nemours Corporation of Bloomington, Del. under the designation "VAZO 64" in 20 grams of ethyl acetate was added to the addition funnel. Both the solution in the reaction vessel and the materials in the addition funnel were then purged with nitrogen. The solution in the reaction vessel was then stirred and heated to 55° C. and initiator was added. After about 20 hours, a 98–99% conversion was obtained. After drying, the adhesive was suitable for application to a backing by the method and apparatus of the present invention.

The application roller was rotated at a rotational velocity sufficient to produce a surface velocity approximately equal to that of the substrate—approximately 2.4 m/s (300 ft/min). A metering bearing was used to restrict the adhesive to a layer measuring approximately 0.3 mm (0.0012 in) thick across the entire surface of the applicator roller and projecting structures. At the application interface, the material was transferred to the surface of the paper, resulting in a layer of adhesive measuring approximately 0.3 mm (0.0012 in) being disposed on the paper. The projecting structures left a plurality of indentations in the adhesive layer, corresponding to the size and spacing of the structures. The paper coated with adhesive in this manner was useful for application to a surface.

The rotational velocity of the application roller was increased to produce a surface velocity of approximately 2.03 m/s (400 ft/min), such that the ratio between the surface velocity and substrate velocity was approximately 4:3. The metering bearing was used to restrict the adhesive to a layer measuring approximately 0.3 mm (0.0012 in) thick across the entire surface of the applicator roller and projecting structures. At the application interface, the material was transferred to the surface of the paper.

Because the application roller was passing the application interface at a greater speed than the substrate, adhesive was coated on the substrate at a greater thickness than on the application roller. The resulting coating thickness on the substrate was approximately 0.36 mm (0.0014 in), and the surface comprised a compressed reverse image of the application roller surface. That is, indentations or striae were formed in the surface of the adhesive in a compressed pattern due to adhesive loading. The paper coated with adhesive in this manner was useful for application to a surface.

Finally, the rotational velocity of the application roller was reduced to produce a surface velocity of approximately 0.5 m/s (100 ft/min), such that the ratio between the surface velocity and the substrate velocity was approximately 1:3. The metering bearing was used to restrict the adhesive to a layer measuring approximately 0.3 mm (0.0012 in) thick across the entire surface of the applicator roller and projecting structures. At the application interface, the material was transferred to the surface of the paper.

Because the application roller was passing the application interface at a lesser speed than the substrate, adhesive was coated on the substrate at a lesser thickness than on the application roller. The resulting coating thickness on the substrate was approximately 0.1 mm (0.0004 in), and the surface comprised a stretched reverse image of the application roller surface. That is, indentations or striae were formed in the surface of the adhesive in an extended pattern due to the difference in velocity between the roller and paper.

An adhesive coating thickness of 0.00127 mm to 0.00381 mm (0.00005 in to 0.0015 in) was obtained, and the adhesive coating was crosslinked by UV radiation from a FUSION brand F-600 UV light source equipped with a 600 watt, 2.5 cm mercury halide bulb. The paper substrate was passed beneath the UV radiation station at a velocity of approximately 1.52 m/s (5.0 ft/s) to crosslink the adhesive to prepare the sample for use. The paper coated with adhesive in this manner was useful for application to a surface.

In sum, the characteristics of the adhesive layer applied to the substrate were changed significantly, without necessitating a change in the application roller.

The present invention has been described with reference to several embodiments thereof. However, persons of skill in the art will recognize that variations may be made in the embodiments described without departing from the scope of the invention. Thus, the scope of the present invention should not be limited by the embodiments shown and described herein, but rather by the structures described by the claims, and the equivalents of those structures.

We claim:

1. An application member for conveying a coating material from a supply of the coating material to a receiving surface, and for applying the material to the receiving surface, said application member comprising:

(a) a hub having a central axis and being adapted for rotation about said axis, said hub comprising a metal peripheral layer defining a generally cylindrical peripheral surface and having indentations along said peripheral surface; and (b) a plurality of discrete structures attached in said indentations along said metal peripheral layer of said hub along said peripheral surface and projecting from and spaced in all directions along said peripheral surface so that rotation of the application member about the central axis enables the peripheral surface carrying the discrete structures to encounter the coating material and receive a layer of the coating material at a source position along the peripheral surface, to carry the coating material on the peripheral surface and the projecting structures to an application interface position along the peripheral surface, and to transfer the layer of coating material from the application member to the receiving surface at the application interface position.

2. An application member according to claim 1, wherein said projecting structures project about 0.76 mm above the peripheral surface of said hub.

3. An application member for conveying a coating material from a supply of the coating material to a receiving surface, and for applying the material to the receiving surface, said application member comprising:

(a) a hub having a central axis and being adapted for rotation about said axis, said hub comprising a metal peripheral layer defining a generally cylindrical peripheral surface;

(b) a plurality of discrete structures projecting from and spaced in all directions along the peripheral surface of the hub; and (c) a layer of release material coated over the peripheral surface of the hub and the projecting members;

rotation of the application member about the central axis enabling the peripheral surface carrying the discrete structures and coated with the layer of release material to encounter the coating material and receive a layer of the coating material at a source position along the peripheral surface, to carry the coating material on the peripheral surface and the projecting structures coated with the layer of release material to an application interface position along the peripheral surface, and to transfer the layer of coating material from the application member to the receiving surface at the application interface position, said transfer being facilitated by said layer of release material.

4. An application member according to claim 3, wherein said metal peripheral layer has a multiplicity of indentations along and defining said peripheral surface, and said projecting structures comprise particles retained within said indentations along the peripheral surface of the hub with portions of the particles projecting above the peripheral surface of the hub.

5. An application member according to claim 4, wherein said particles comprise tungsten carbide.

6. An application member according to claim 4, wherein said projecting structures project about 0.76 mm above the peripheral surface of said hub.

7. An application member according to claim 2 further including a layer of release material over the peripheral surface and said projecting structures to facilitate transfer of the coating material from the application member to the receiving surface.

8. An application system for applying a coating material to a receiving surface, said system comprising:

(a) an application member comprising a hub having a central axis and a metal peripheral layer defining a generally cylindrical peripheral surface, and a plurality of discrete structures projecting from and spaced in all directions along said peripheral surface;

(b) means for rotating said application member about said axis to provide a surface velocity at said peripheral surface and to move said peripheral surface along a generally cylindrical path from a source position to an application interface position along said path;

(c) means operable when said means for rotating is rotating said application member for causing said application member to receive the coating material on said peripheral surface and said structures at said source position and for carrying a layer of the coating material on said peripheral surface and said structures to said application interface position; and (d) receiving surface moving means for moving said receiving surface at a surface velocity along a path having a path portion at said application interface position, said receiving surface moving means moving said receiving surface in the same direction as said peripheral surface is moved by said means for rotating at said application interface position, and said receiving surface being in sufficiently close face to face relationship with a portion of said peripheral surface along said path portion at said application interface position to afford transfer of the layer of coating material on said application member to said receiving surface.

9. An application system according to claim 8, wherein said projecting structures comprise a plurality of hemispheres projecting about 0.76 mm above the peripheral surface of said hub.

10. An application system according to claim 8, wherein said application member includes a layer of release material coated over the peripheral surface of the hub and the projecting members to facilitate transfer of the layer of coating material from the application member to the receiving surface.

11. An application system according to claim 8, wherein the receiving surface is defined by a substrate, and said receiving surface moving means is adapted for moving the substrate along said path.

12. An application system according to claim 8, wherein said application system includes a primary application member defining said receiving surface, said application member being adapted to apply the layer of coating material received at the application interface position to a substrate.

13. An application system according to claim 8, wherein said means for rotating said application member moves the peripheral surface of said application member at a surface velocity greater than the surface velocity said receiving surface is moved by said receiving surface moving means to increase the thickness of the layer of coating material transferred to said receiving surface at said application interface position.

14. An application system according to claim 8, wherein said means for rotating said application member moves the peripheral surface of said application member at a surface velocity less than the surface velocity said receiving surface is moved by said receiving surface moving means to decrease the thickness of the layer of coating material transferred to said receiving surface at said application interface position.

15. A method for applying a coating material to a receiving surface, said method comprising the steps of:

(a) providing an application member comprising a hub having a central axis and a metal peripheral layer defining a generally cylindrical peripheral surface, and a plurality of discrete structures projecting from and spaced in all directions along the peripheral surface;

(b) rotating the application member about the axis to provide a surface velocity at the peripheral surface and to move the peripheral surface along a generally cylindrical path from a source position to an application interface position along the path;

(c) causing the application member to receive the coating material on the peripheral surface and the structures at the source position and to carry a layer of the coating material on the peripheral surface and the structures to the application interface position; and (d) moving the receiving surface at a surface velocity along a path having a path portion at the application interface position in the same direction along the path portion as the peripheral surface is moved at the application interface position with the receiving surface in sufficiently close face to face relationship with a portion of the peripheral surface along the path portion to transfer the layer of coating material to the receiving surface.

16. A method according to claim 15, wherein the peripheral surface of the application member is moved at a surface velocity greater than tile surface velocity at which the receiving surface is moved to increase the thickness of the layer of coating material transferred to the receiving surface at the application interface position.

17. A substrate having a receiving surface coated with a coating of coating material by the method of claim 15, said coating of coating material having indentations or striae along the surface of said coating opposite said receiving surface.

18. A method according to claim 15, wherein the peripheral surface of the application member is moved at a surface velocity less than the surface velocity at which the receiving surface is moved to decrease the thickness of the layer of coating material transferred to the receiving surface at the application interface position.

19. A method according to claim 15, wherein the peripheral surface of the application member is moved at essentially the same surface velocity that the receiving surface is moved so that the thickness of the layer of coating material transferred to the receiving surface remains generally the same at the application interface position.

20. A substrate according to claim 17, wherein the substrate is paper, and the coating material is pressure sensitive adhesive.

21. A method of making an application member for applying a coating material to a receiving surface, said method comprising the sequential steps of:

(a) providing a hub having a metal peripheral layer defining a generally cylindrical peripheral surface;

(b) grit blasting the peripheral surface to form a plurality of discrete indentations in the metal peripheral layer along the peripheral surface; and (c) impelling particles against the peripheral surface so that particles are lodged within substantially all of the indentations with a portion of each particle projecting above the peripheral surface of the hub;

whereby the application member is adapted to carry the coating material on and between the particles to the receiving surface.

22. A method according to claim 21, wherein the particles comprise tungsten carbide.

23. A method according to claim 21, further comprising the step of:

(d) coating the peripheral surface and the particles with a release coating to facilitate transfer of the coating material from the application member to the receiving surface.

24. A method according to claim 23 wherein the release coating comprises a fluorocarbon.

* * * * *